US006304162B1

(12) United States Patent
Nakatsuka et al.

(10) Patent No.: US 6,304,162 B1
(45) Date of Patent: Oct. 16, 2001

(54) ANISOTROPIC PERMANENT MAGNET

(75) Inventors: Satoshi Nakatsuka; Osamu Sasaki; Masaharu Abe, all of Hiroshima-ken (JP)

(73) Assignee: Toda Kogyo Corporation, Hiroshima (JP)

( * ) Notice: Subject to any disclaimer, the term of this patent is extended or adjusted under 35 U.S.C. 154(b) by 0 days.

(21) Appl. No.: 09/597,615

(22) Filed: Jun. 20, 2000

(30) Foreign Application Priority Data

Jun. 22, 1999 (JP) ..... 11-175067
Jul. 13, 1999 (JP) ..... 11-198641

(51) Int. Cl.[7] ..... H01F 7/02
(52) U.S. Cl. ..... 335/302
(58) Field of Search ..... 335/302–306

(56) References Cited

U.S. PATENT DOCUMENTS 4,536,230 * 8/1985 Landa et al. ..... 148/31.57
4,888,512 * 12/1989 Shimizu ..... 310/156
5,416,457 * 5/1995 Nakatsuka et al. ..... 335/302
5,516,371 * 5/1996 Kim et al. ..... 148/104

FOREIGN PATENT DOCUMENTS 62-20302 * 1/1987 (JP) .
10-270236 * 10/1998 (JP) .

* cited by examiner

*Primary Examiner*—Lincoln Donovan
(74) *Attorney, Agent, or Firm*—Armstrong, Westerman, Hattori, McLeland & Naughton, LLP

(57) ABSTRACT

An anisotropic permanent magnet with an improved surface magnetic field peak value is provided, which has at least one active surface and is oriented and magnetized simultaneously in such a manner that axes of easy magnetization of magnetic powder constituting the permanent magnet pass from the active surface through an interior of the magnet to return to the active surface, wherein a standard magnetic pole and a background opposite magnetic pole are present as an island and a sea, and the ratio of an area of the standard magnetic pole to an area of the background opposite magnetic pole is 9 to 90:91 to 10. Also, a permanent magnet for attraction with an improved attraction force is provided, wherein a total area ΣS of an S pole surface and a total area ΣN of an N pole surface satisfy a relationship: $0.5\times\Sigma S \leqq \Sigma N \leqq 2.0\times\Sigma S$ or $0.5\times\Sigma N \leqq \Sigma S \leqq 2.0\times\Sigma N$.

10 Claims, 18 Drawing Sheets

ANISOTROPIC PERMANENT MAGNET

BACKGROUND OF THE INVENTION

1. Field of the Invention

The present invention relates to an anisotropic permanent magnet, and more particularly to an anisotropic permanent magnet with an improved surface magnetic field peak value, an anisotropic permanent magnet for a signal using the same, and a permanent magnet for attraction with an improved attraction force.

The anisotropic permanent magnet with an improved surface magnetic field peak value according to the present invention is useful particularly as a signal magnet that eliminates signal reading errors and as a magnet that allows use of a less sensitive inexpensive magnetic sensor for controlling the speed of a small motor, for a magnetic length-measuring apparatus, and for various other fields of application utilizing a magnetic signal. Further, since the surface magnetic field peak value is large, it can be made of an inexpensive ferrite magnet and is useful, for example, as an inexpensive magnet for a health appliance.

Furthermore, the permanent magnet with an improved attraction force according to the present invention is useful as a permanent magnet for attraction with an improved attraction force for attracting and fixing an object of fixation such as paper or a sheet onto an object of attraction such as a white board or a bulletin board or for preventing inadvertent dislocation of such an object of fixation by utilizing the attraction force of said permanent magnet.

2. Description of the Prior Art

As a magnet for signals, a sintered magnet made of a rare earth or ferrite material and a synthetic resin magnet have been conventionally used. These are all anisotropic magnets in which the orientation of magnetic powder is in the thickness direction (axial direction) as shown in FIG. 12, and therefore the intensity of magnetic signals has been limited. Further, an isotropic one has a problem that the magnetic signals thereof are weaker than those of a magnet which is anisotropic in the thickness direction.

In order to solve these problems, Japanese Examined Patent Publication No. 63-59243 proposes a magnet in which the direction of the axes of easy magnetization is orientated to be converged from nonactive surfaces towards an active surface, and Japanese Laid-open Patent Publication No. 06-13223 proposes a magnet in which the orientation direction of the axes of easy magnetization passes from an active surface through the interior of the magnet to be converged to the active surface again.

However, the surface magnetic field peak value of the aforesaid magnets is not necessarily satisfactory though it is larger as compared with anisotropic magnets orientated in the thickness direction, so that a further improvement in the peak value is demanded.

Meanwhile, as a magnet for attraction, conventionally, a sintered magnet made of a rare earth or ferrite material and a synthetic resin magnet have been used. These are all anisotropic magnets in which the orientation of magnetic powder is in the axial direction (thickness direction) as shown in FIG. 32, and therefore whether the magnet is good or bad is determined solely by the orientation degree of the magnetic powder, if the kind and the content of the material used therein are specified.

In order to solve this problem, the aforesaid Japanese Examined Patent Publication No. 63-59243 proposes a permanent magnet with an improved attraction force.

However, in the permanent magnet disclosed in the aforesaid Publication, the direction of the axes of easy magnetization is oriented to be converged from nonactive surfaces (all the surfaces other than the active surface) towards an active surface as shown in FIG. 31. According to this magnet, the magnetic flux density per unit area can be increased as compared with conventional ones. However, the attraction force of the aforesaid magnet having a converging orientation is not necessarily sufficient though it is larger as compared with magnets orientated in the axial direction, so that a further improvement in the attraction force is demanded.

SUMMARY OF THE INVENTION

An object of the present invention is to provide an anisotropic permanent magnet with an improved surface magnetic field peak value.

Another object of the present invention is to provide a permanent magnet for a signal.

Still another object of the present invention is to provide a permanent magnet for attraction with an improved attraction force.

Other objects and advantages of the present invention will be apparent to those skilled in the art by the following description.

The inventors of the present invention have made an extensive series of studies in order to achieve the aforesaid objects, and have reached an idea that, in order to improve the attraction force of a permanent magnet, the magnetic lines of force that are wastefully radiated from a nonactive surface should be made fewer in number when the magnet is attracted. In this sense, the inventors have considered that an optimal orientation is to allow the axes of easy magnetization of magnetic powder to be directed from the active surface to the interior of the magnet and then to return to the active surface again. As a result of further studies, the inventors have found out that the surface magnetic field peak value can be remarkably increased by controlling the area ratio of a standard magnetic pole to a background opposite magnetic pole to be within a specific range, and also found out that the attraction force increases when the total area of the standard magnetic pole and the total area of the opposite pole satisfy a predetermined relationship, thereby reaching the present invention.

DETAILED DESCRIPTION OF THE INVENTION

Figure 1:
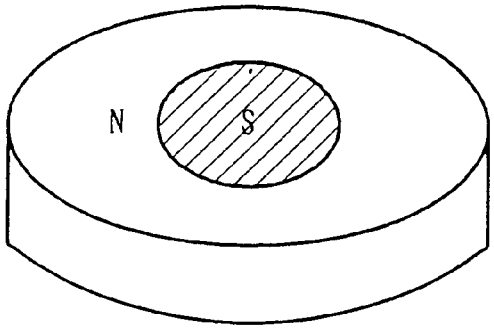
FIG. 1 is a perspective view illustrating an example of an anisotropic permanent magnet according to the present invention.

A first aspect of the present invention is an anisotropic permanent magnet having at least one active surface and being oriented and magnetized simultaneously in such a manner that axes of easy magnetization of a magnetic powder constituting said permanent magnet pass from the active surface through an interior of the magnet to return to the active surface, an improvement wherein a standard magnetic pole and a background opposite magnetic pole are present as an island and a sea, and the ratio of an area of the standard magnetic pole to an area of the background opposite magnetic pole is 9 to 90:91 to 10.

A preferred embodiment is an anisotropic permanent magnet wherein the permanent magnet contains a magnetic powder and a synthetic resin as major components.

A preferred embodiment is an anisotropic permanent magnet which is produced by means of a mold in which the standard magnetic pole is made of a rare earth sintered magnet as a magnetomotive force portion of a magnetic circuit of the mold.

A preferred embodiment is an anisotropic permanent magnet which is produced by means of a mold having a heated sprue and runner.

A second aspect of the present invention is an anisotropic permanent magnet for a signal, which is made of the aforesaid anisotropic permanent magnet.

A preferred embodiment is an anisotropic permanent magnet for a signal wherein the standard magnetic pole for the signal is located at a center of the background opposite magnetic pole for each fundamental signal unit.

A preferred embodiment is an anisotropic permanent magnet for a signal, which is constructed by repetition of fundamental signal units.

A third aspect of the present invention is a permanent magnet for attraction having an active surface constructed with a plane and comprising an anisotropic magnet which is oriented and magnetized simultaneously, or remagnetized in the same pattern as simultaneous orientation and magnetization, or remagnetized by application of an inverse magnetic field in the same pattern, in such a manner that axes of easy magnetization of a magnetic powder constituting the permanent magnet pass from the active surface through an interior of the magnet to return to the active surface, an improvement wherein a total area $\Sigma S$ of an S pole surface and a total area $\Sigma N$ of an N pole surface satisfy a relationship: $0.5\times\Sigma S \leqq \Sigma N \leqq 2.0\times\Sigma S$ or $0.5\times\Sigma N \leqq \Sigma S \leqq 2.0\times\Sigma N$.

A preferred embodiment is a permanent magnet for attraction wherein a maximum width Pmax of a magnetization pattern of the active surface and a thickness T of the anisotropic magnet, which is oriented and magnetized simultaneously, or remagnetized in the same pattern as simultaneous orientation and magnetization, or remagnetized by application of an inverse magnetic field in the same pattern, satisfy a relationship: $0.5\times T<Pmax<2.0\times T$.

A preferred embodiment is a permanent magnet for attraction wherein a ratio (Pmax/Pmin) of a maximum value Pmax to a minimum value Pmin of a width P of a magnetization pattern of the active surface of the anisotropic magnet, which is oriented and magnetized simultaneously, or remagnetized in the same pattern as simultaneous orientation and magnetization, or remagnetized by application of an inverse magnetic field in the same pattern, is not more than 2.

First, a first and a second aspects of the present invention will be specifically described.

Figure 2:
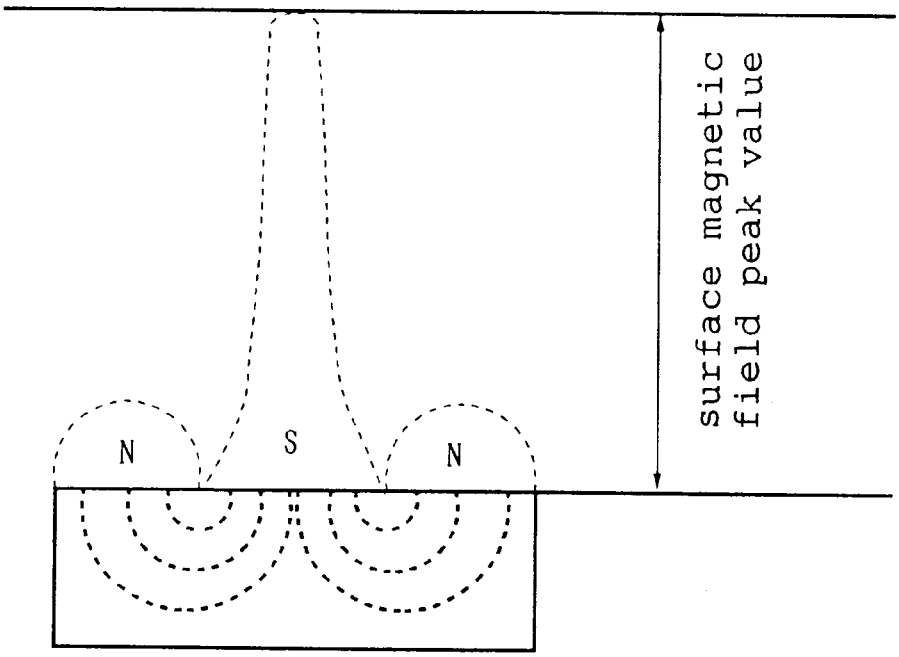
FIG. 2 is a schematic view showing an orientation state and a surface magnetic field peak value of the anisotropic permanent magnet of FIG. 1.

Referring to FIG. 1, an anisotropic permanent magnet according to the first aspect of the present invention has at least one active surface. Referring to FIG. 2, the anisotropic permanent magnet of the present invention is oriented and magnetized simultaneously in such a manner that axes of easy magnetization of a magnetic powder constituting the permanent magnet pass from the active surface through an interior of the magnet to return to the active surface, wherein a standard magnetic pole (an S-pole shown in hatches in FIG. 1) and a background opposite magnetic pole (an N-pole in FIG. 1) are present as an island and a sea, and the ratio of an area of the standard magnetic pole to an area of the background opposite magnetic pole is 9 to 90:91 to 10, preferably 16 to 81:84 to 19, most preferably 30 to 40:70 to 60. The surface magnetic field peak value increases considerably by controlling the area ratio of the two poles in this manner.

The reason why the surface magnetic field peak value increases by setting the area ratio of the two poles to be within the aforesaid range is not necessarily clear. However, it is surmised that, if the ratio of the area of the standard magnetic pole to the area of the background opposite magnetic pole exceeds 90/10, the orientation of the magnetic powder near the standard magnetic pole becomes more orientated in the thickness direction, which is disadvantageous for the improvement of the surface magnetic field peak value with respect to the converging angle in the magnetic powder orientation direction. On the other hand, if the ratio is smaller than 9/91, it is disadvantageous with respect to the magnetic resistance of the magnetic circuit of magnetic field orientation, though it is advantageous for the improvement of the peak value with respect to the converging angle in the magnetic powder orientation direction. It is surmised that, as a result of this, the orientation magnetic field at the time of production decreases, so that the peak value of the surface magnetic field from the standard magnetic pole of the obtained magnet does not increase as expected.

The anisotropic permanent magnet of the present invention may be either a synthetic resin magnet or a sintered magnet. The magnetic powder to be used in the synthetic resin magnet or the sintered magnet can be a conventionally known anisotropic magnetic powder such as ferrite magnetic powder, AlNiCo magnetic powder, or rare earth magnetic powder such as samarium-cobalt magnetic powder, neodymium-iron-boron magnetic powder, samarium-iron-nitrogen magnetic powder.

The synthetic resin used as a binder can be any of conventionally known ones. Representative examples thereof include polyamide synthetic resins such as polyamide 6, polyamide 12, and polyamide 66; homopolymerized or copolymerized vinyl synthetic resins such as polyvinyl chloride, vinyl chloride-vinyl acetate copolymer, polymethyl methacrylate, polystyrene, polyethylene, and polypropylene; synthetic resins such as polyurethane, silicone, polycarbonate, polyesters such as PBT and PET, polyether ether ketone, PPS, chlorinated polyethylene, and chlorosulfonated polyethylene ("Hypalon":trade name of du Pont); rubbers such as isoprene, neoprene, styrene-butadiene, butadiene, and acrylonitrile-butadiene; epoxy resins, and phenolic synthetic resins. These are used either alone or as a combination of two or more, if necessary.

The blending ratio of the magnetic powder and the synthetic resin as a binder is preferably within the range of 40 to 70 vol % of the magnetic powder and 60 to 30 vol % of the synthetic resin. If the magnetic powder is less than 40 vol %, the attraction force is insufficient, whereas if it is more than 70 vol %, the moldability is liable to be poor.

It goes without saying that, in addition to these, conventionally used plasticizers, antioxidants, surface treatment agents, and others can be used in accordance with the intended object.

The molding method to be used can be an already known method such as injection molding or compression molding in the case of a synthetic resin magnet, and an already known method such as wet molding or dry molding can be used as a green preparation method in the case of a sintered magnet.

The method of magnetic field orientation excitement for use in the present invention can be a permanent magnet method or an electromagnet method already known in the art. In the case of using a rare earth magnetic powder, the electromagnet method is advantageous because a large applied magnetic field can be expected.

However, in the case of using a ferrite magnetic powder, the mold can be constructed to be compact and produced at a low cost by using a rare earth magnet for standard magnetic pole field (center pole field) and using a ferromagnetic substance such as iron for the background opposite magnetic pole.

The permanent magnet for exciting the magnetic circuit of the mold for use in the present invention is preferably an already known rare earth sintered magnet such as a neodymium-iron-boron sintered magnet or a samarium-cobalt sintered magnet. The ferromagnetic substance for the background magnetic pole for use in the present invention can be S45C or a die steel SKD11, which are already known mold members.

In the case of injection molding, it is preferable to heat a passage of a melted resin such as a sprue and a runner in view of improving the orientation degree of the magnetic powder.

The anisotropic permanent magnet of the present invention can be applied not only to a square-shaped magnet and a disk-shaped magnet, but also to magnets having various shapes, for example, polygonal shapes such as triangular, pentagonal, hexagonal and octagonal, a hollow disk shape, an annulus shape, a cylindrical shape, a conical shape, a polygonal pyramid shape, a long shape, or a shape having two or more connected disks.

Further, the anisotropic permanent magnet of the present invention may include a handle made of the same magnet composition disposed on the nonactive surface side. Alternatively, a handle may be formed by insert molding, matching after molding, or bonding with the use of another engineering plastic. The handle may have an already known shape such as a pot lid form or an inverted silk hat form. Further, a shape having a handle made by removing a portion of the magnet composition that is located on the nonactive surface side of the permanent magnet of the present invention and does not contribute so much to the intended action, can save the materials and is advantageous in terms of costs.

Figure 3:
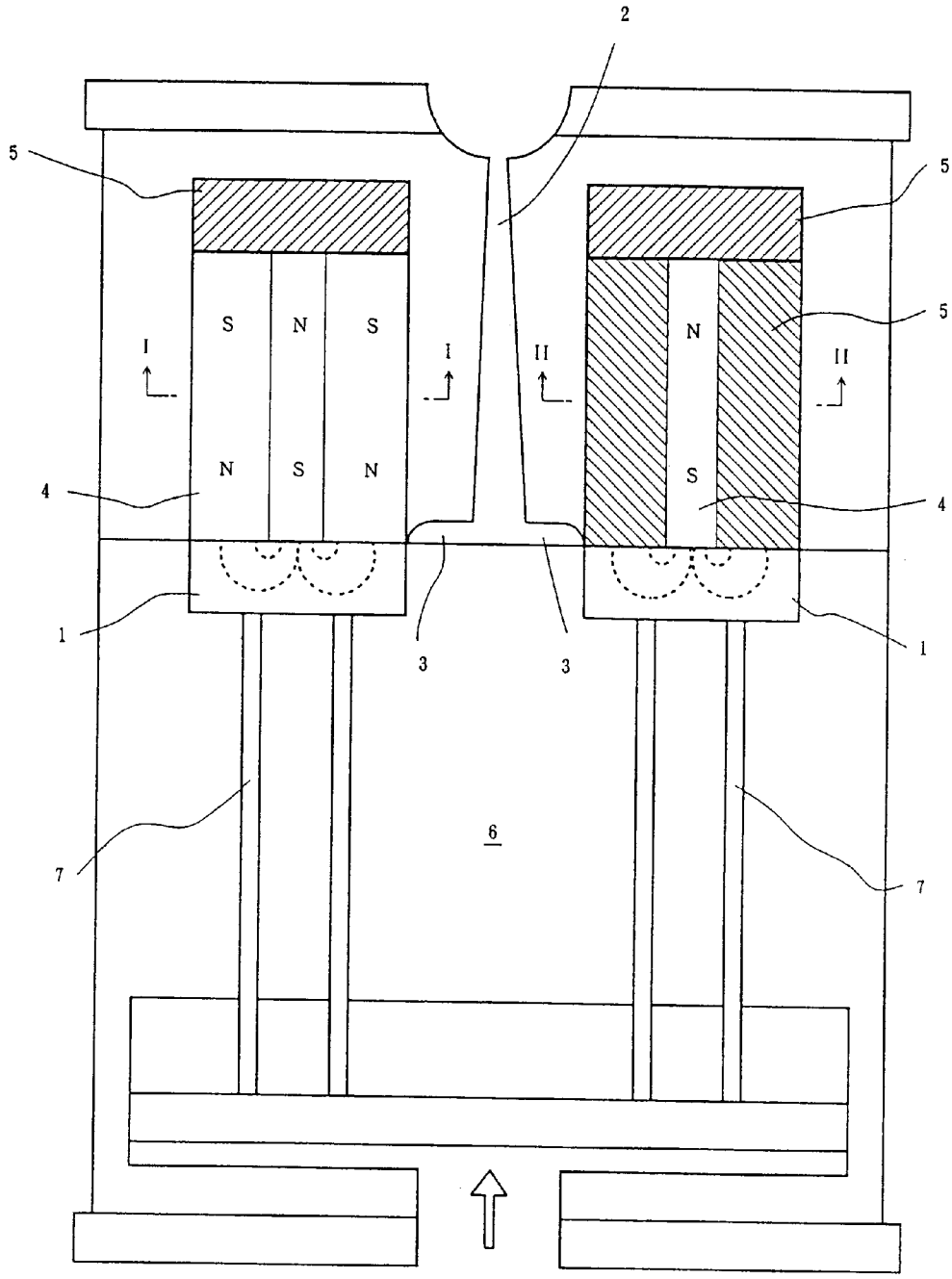
FIG. 3 is a schematic view illustrating an example of a mold for magnetic field orientation injection molding.
Figure 4:
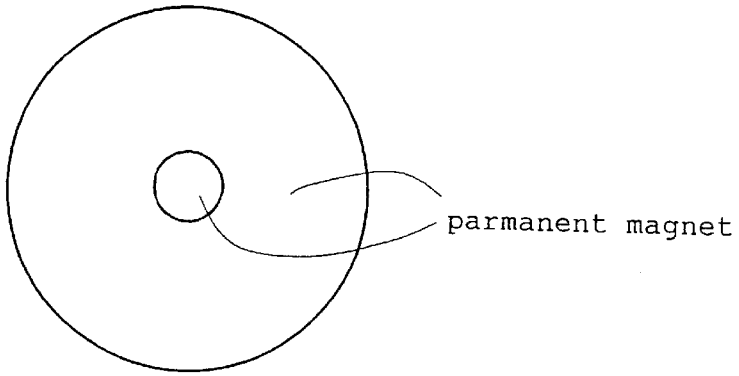
FIG. 4 is a cross-sectional view along the line I—I of FIG. 3.
Figure 5:
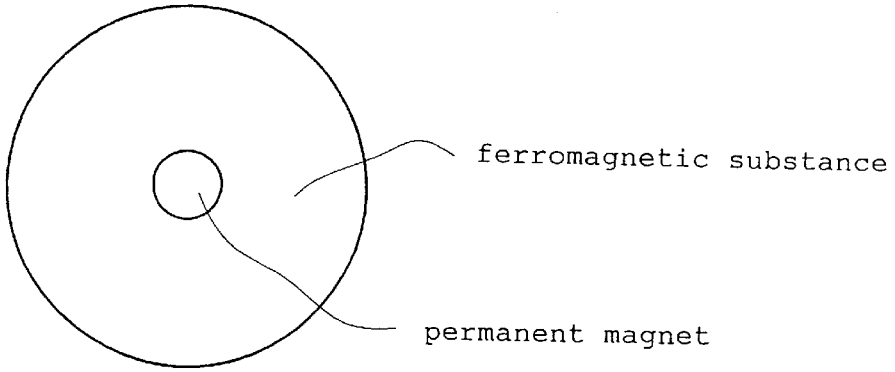
FIG. 5 is a cross-sectional view along the line II—II of FIG. 3.

FIG. 3 is a schematic view illustrating an example of a multiple-cavity mold for injection molding, where cavities 1, a sprue 2, runners 3, permanent magnets 4, yokes (ferromagnetic substance) b 5, a nonmagnetic substance 6, and ejector pins 7 are shown. FIG. 4 is a cross-sectional view along the line I—I of FIG. 3, and FIG. 5 is a cross-sectional view along the line II—II of FIG. 3.

A resin magnet composition containing a magnetic powder and a synthetic resin as major components is introduced into the cavities 1 through the sprue 2 and the runners 3, and the axes of easy magnetization of the magnetic powder particles are oriented along the magnetic line of force in such a manner as to pass from the active surface through an interior of the magnet to return to the active surface again, as shown by arrows. Here, although FIG. 3 shows an example that uses a permanent magnet, it goes without saying that an electromagnet can be used instead. In order to heat the sprue 2 and the runners 3, a heater or the like may be disposed in the vicinity thereof.

The compression molding apparatus for use in the present invention may be a known one, and a magnetic circuit similar to that of the mold for injection molding may be incorporated therein.

Since the anisotropic permanent magnet of the present invention has a greatly improved surface magnetic field peak value, it is useful for controlling the speed of a small motor, for a magnetic length-measuring apparatus, and for various other fields of application utilizing a magnetic signal.

Figure 6:
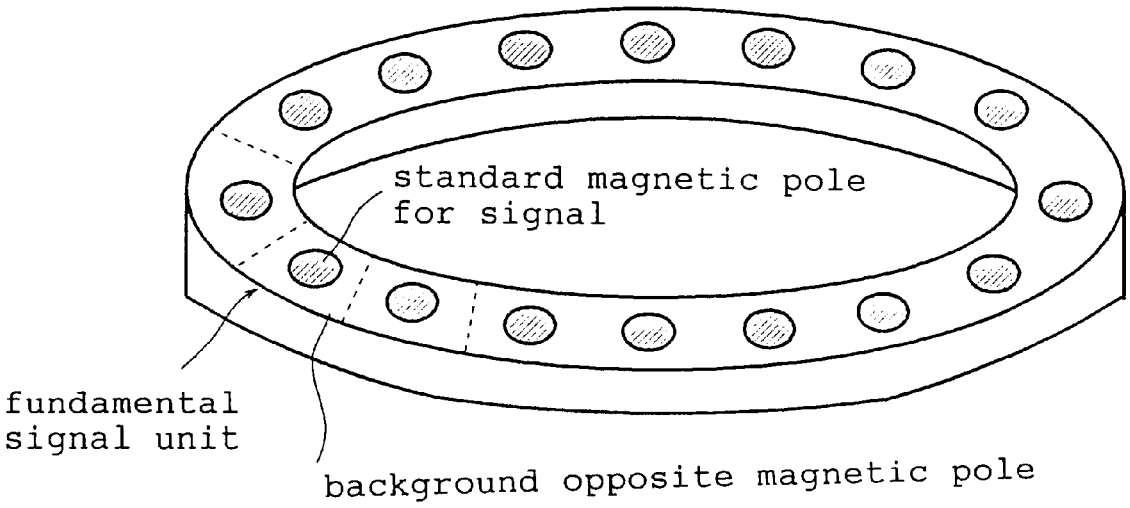
FIG. 6 is a schematic view illustrating an annular magnet.

In this case, in view of increasing the peak value of a magnetic signal, it is preferable if the anisotropic permanent magnet is not only constructed by repetition of fundamental signal units, but the standard magnetic pole for the signal is located at a center of the background opposite magnetic pole for each fundamental signal unit, as shown for example in FIG. 6.

Next, a third aspect one of the present invention will be specifically described.

A permanent magnet for attraction according to the third aspect one of the present invention has an active surface constructed with a plane. This corresponds to the fact that the object surface for attraction such as the side surface or the front surface of a wall of a soft magnetic substance, a white board, or a case made of an iron plate, or a bulletin board, which are the objects of attraction, is usually a plane. The plane referred to in the present invention may be a substantially planar surface. For example, if the object of attraction has an object surface for attraction which is formed of a little curved surface, a magnet having an active surface along the curved surface can be used to meet the purpose.

In the permanent magnet for attraction according to the present invention, a total area $\Sigma S$ of an S pole surface and a total area $\Sigma N$ of an N pole surface should satisfy a relationship: $0.5\times\Sigma S\leqq\Sigma N\leqq 2.0\times\Sigma S$ or $0.5\times\Sigma N\leqq\Sigma S\leqq 2.0\times\Sigma N$, preferably $0.75\times\Sigma S\leqq\Sigma N\leqq 1.5\times\Sigma S$ or $0.75\times\Sigma N\leqq\Sigma S\leqq 1.5\times\Sigma N$, more preferably $0.9\times\Sigma S\leqq\Sigma N\leqq 1.2\times\Sigma S$ or $0.9\times\Sigma N\leqq S\leqq 1.2\times\Sigma N$, on the active surface of an anisotropic magnet which is oriented and magnetized simultaneously, or remagnetized in the same pattern as simultaneous orientation and magnetization, or remagnetized by application of an inverse magnetic field in the same pattern, in such a manner that axes of easy magnetization of a magnetic powder constituting the permanent magnet pass from the active surface through an interior of the magnet to return to the active surface again. It is particularly preferable if $\Sigma S=\Sigma N$. If $\Sigma S$ and $\Sigma N$ do not satisfy the above-mentioned relationship, the attraction force cannot be sufficiently improved.

The reason for this is not necessarily clear. However, it is supposed that, in the case where a permanent magnet is attracted to a soft magnetic substance such as iron, if the balance between $\Sigma S$ and $\Sigma N$ is deviated in a magnetic circuit in which the magnetic flux passes from the surface of the magnetic pole on the active surface along the axes of easy magnetization in the interior of the magnet to reach the opposite pole on the active surface and then passes through the interior of the soft magnetic substance to return to the surface of the magnetic pole on the active surface, the total magnetic flux of this closed magnetic circuit decreases to give a weaker attraction force as a result of the fact that the magnetic pole having a smaller total area of the magnetic pole on the active surface does not magnetically permit a magnetic flux larger than the saturation magnetic flux.

Furthermore, under the aforesaid condition, the maximum width of a magnetization pattern of the active surface, i.e. the maximum pitch Pmax and the thickness T of the anisotropic magnet, which is oriented and magnetized simultaneously, or remagnetized in the same pattern as simultaneous orientation and magnetization, or remagnetized by application of an inverse magnetic field in the same pattern, preferably satisfy a relationship: $0.5\times T\leqq Pmax\leqq 2.0\times T$. If Pmax is smaller than $0.5\times T$, the magnet composition on the nonactive surface side goes out of the magnetic circuit that contributes to the attraction, so that it is uneconomical in terms of costs. On the other hand, if Pmax exceeds $2.0\times T$, the arrangement of the axes of easy magnetization will be warped greatly, so that the magnetic flux leaks out to the nonactive surface side to increase the magnetic resistance with respect to the magnetic circuit that contributes to the attraction, and the magnetic flux density decreases to give a weaker attraction force.

Further, the attraction force per unit volume can be improved more by designing a permanent magnet in such a manner that the ratio (Pmax/Pmin) of the maximum value Pmax to the minimum value Pmin of the width P of a magnetization pattern of the active surface of the anisotropic magnet, which is oriented and magnetized simultaneously, or remagnetized in the same pattern as simultaneous orientation and magnetization, or remagnetized by application of an inverse magnetic field in the same pattern, is preferably not more than 2, more preferably not more than 1.5, still more preferably not more than 1.2.

The permanent magnet for attraction of the present invention is produced by a method similar to the one used in producing the above-described permanent magnet with an improved surface magnetic field peak value.

Figure 13:
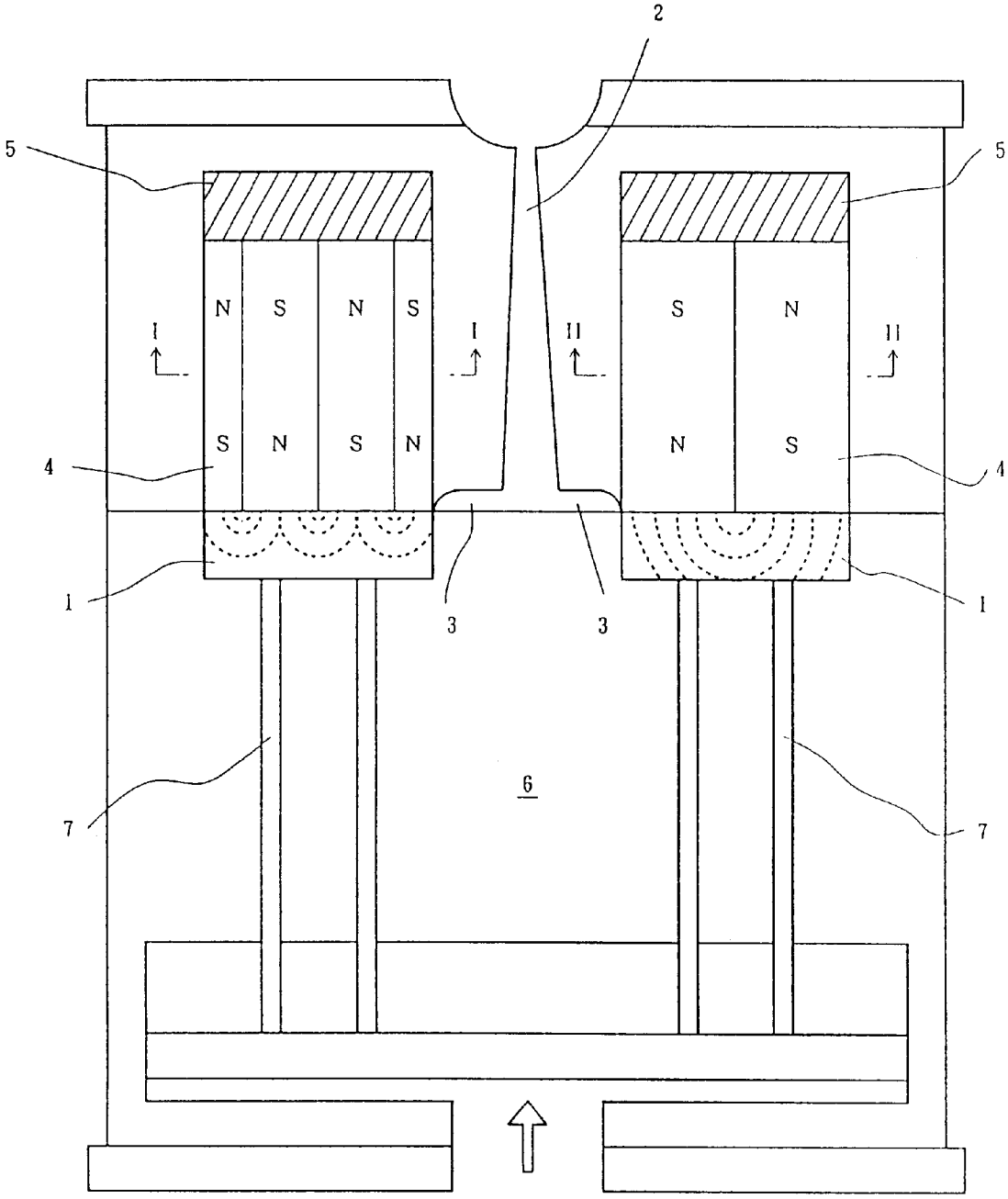
FIG. 13 is a schematic view illustrating an example of a mold for magnetic field orientation injection molding.
Figure 14:
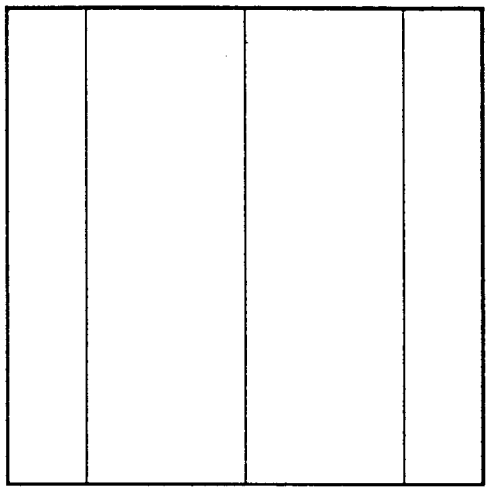
FIG. 14 is a cross-sectional view along the line I—I of FIG. 13.
Figure 15:
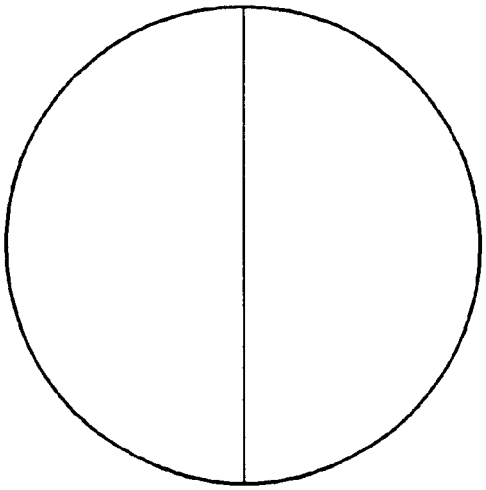
FIG. 15 is a cross-sectional view along the line II—II of FIG. 13.
Figure 16:
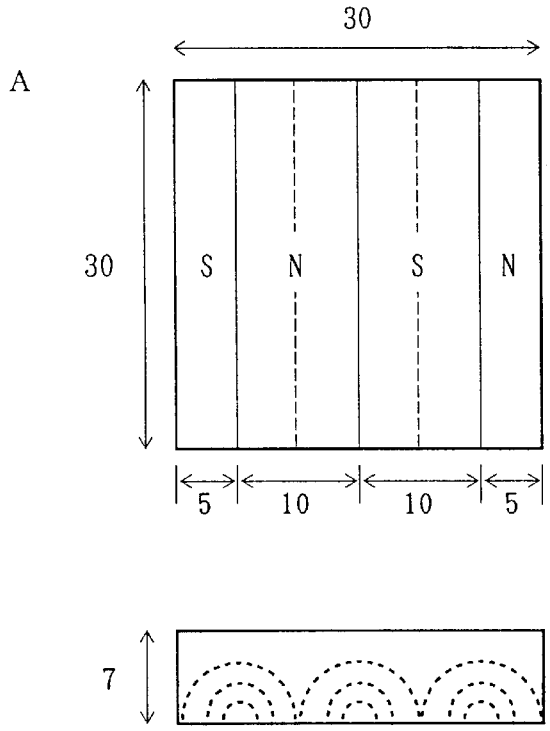
FIG. 16 is a schematic view illustrating a magnetic circuit and an orientation state.
Figure 17:
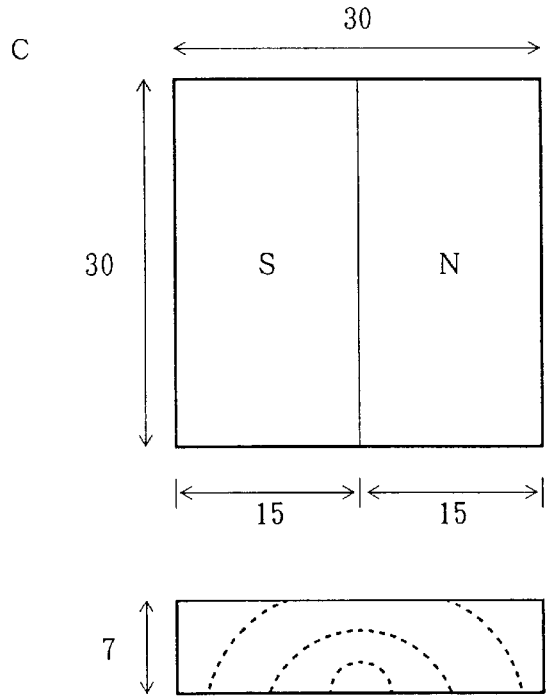
FIG. 17 is a schematic view illustrating a magnetic circuit and an orientation state.
Figure 18:
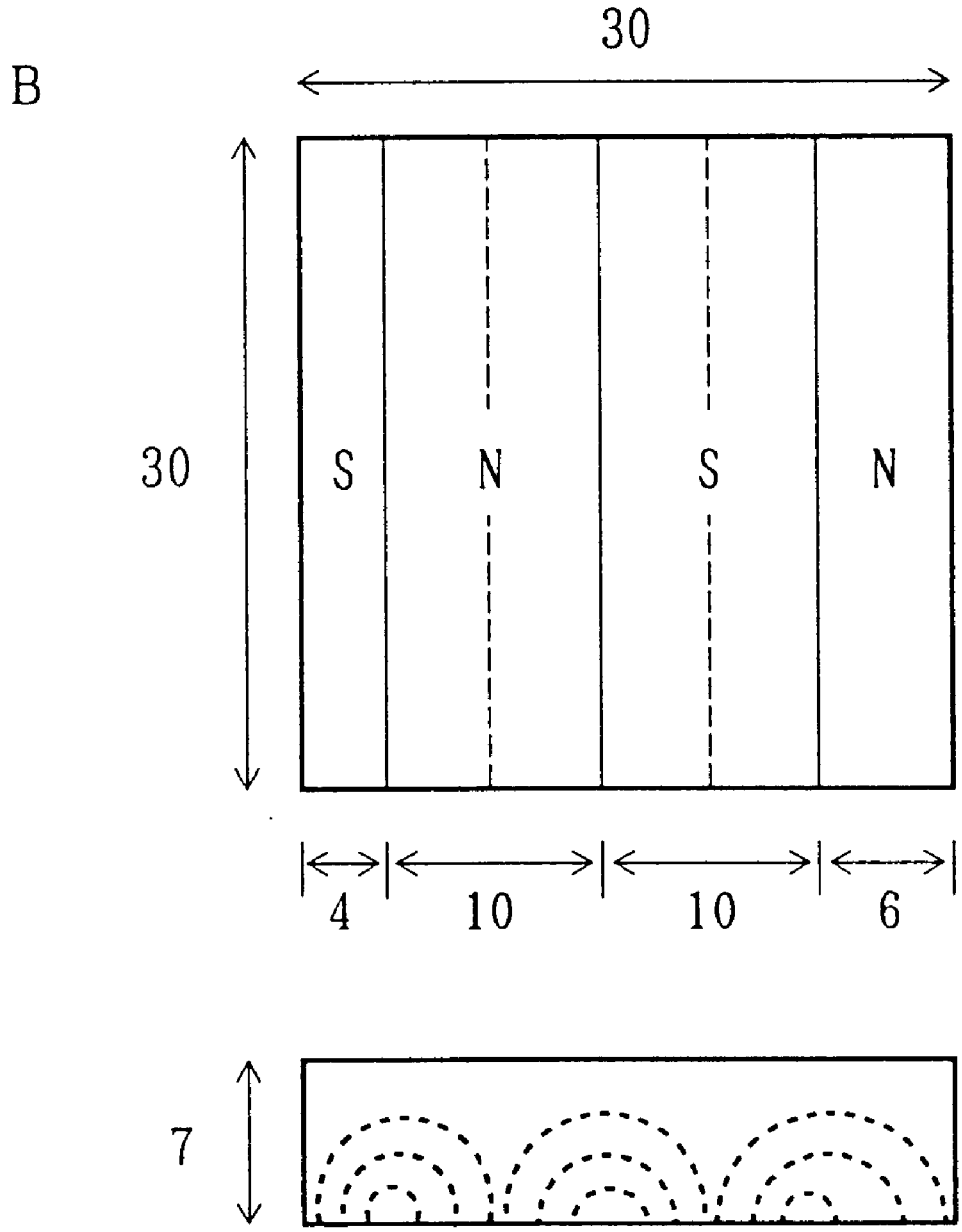
FIG. 18 is a schematic view illustrating a magnetic circuit and an orientation state.
Figure 19:
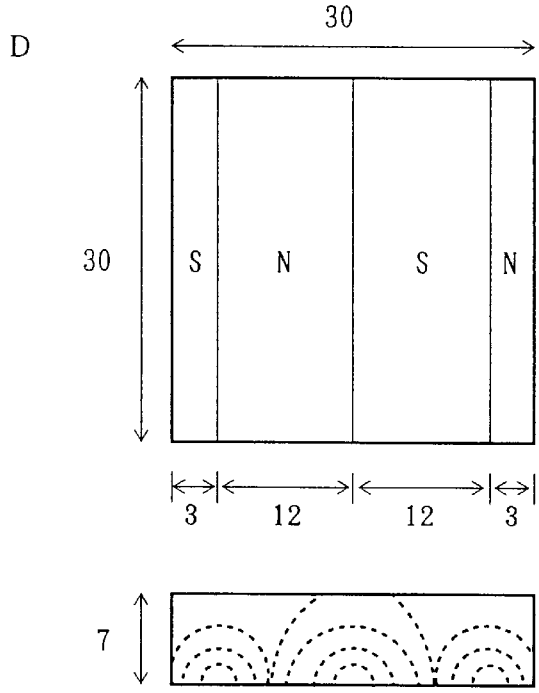
FIG. 19 is a schematic view illustrating a magnetic circuit and an orientation state.
Figure 20:
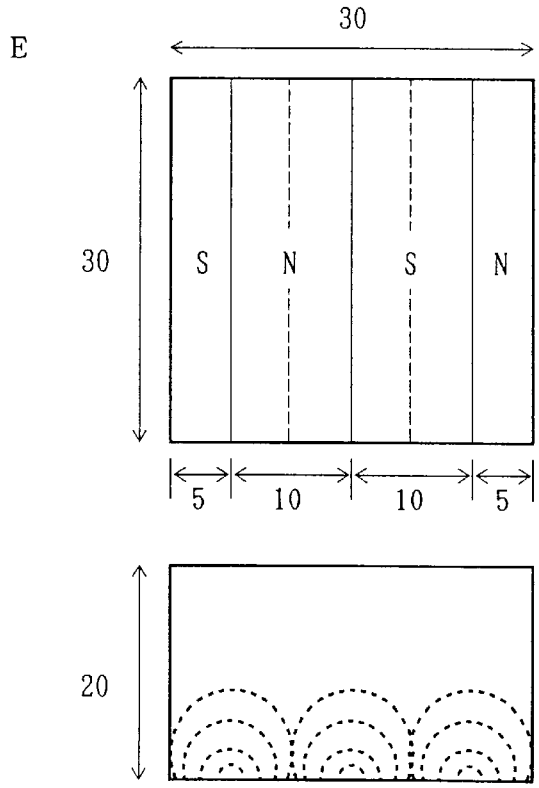
FIG. 20 is a schematic view illustrating a magnetic circuit and an orientation state.
Figure 21:
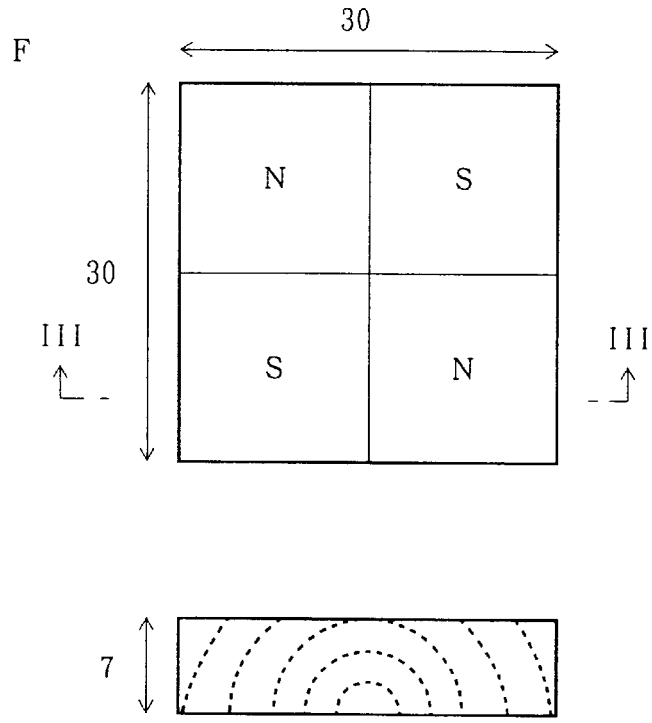
FIG. 21 is a schematic view (cross section along the line III—III) illustrating a magnetic circuit and an orientation state.
Figure 22:
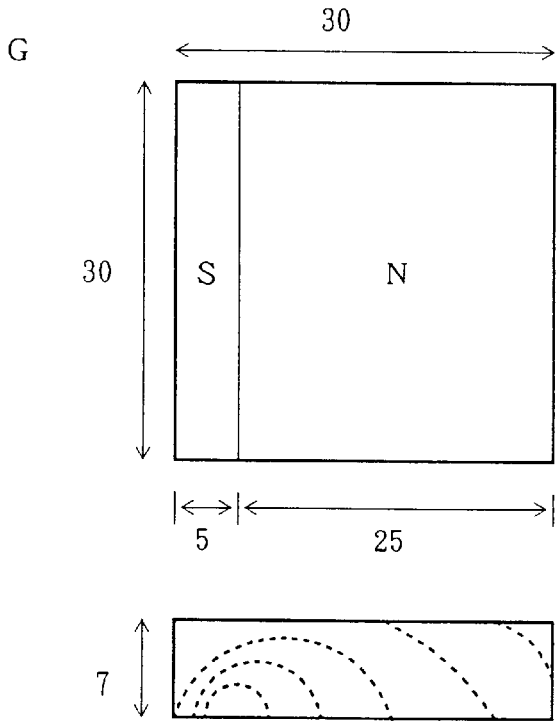
FIG. 22 is a schematic view illustrating a magnetic circuit and an orientation state.
Figure 23:
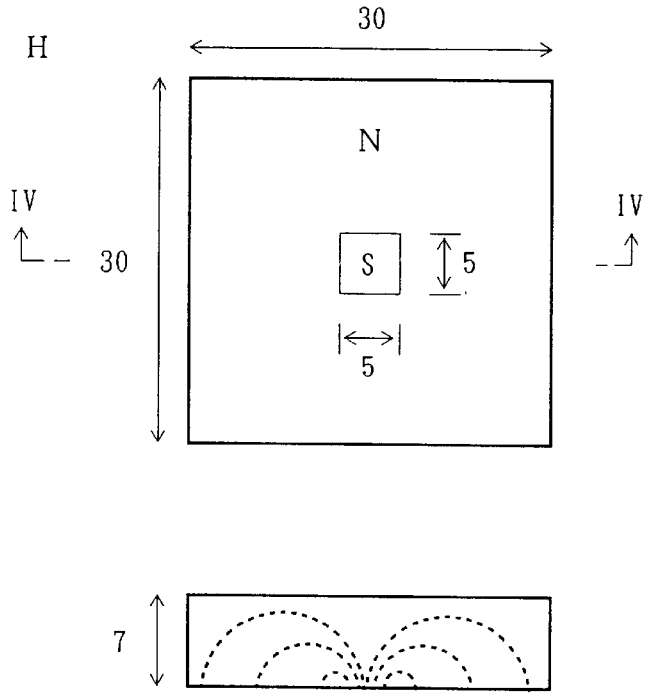
FIG. 23 is a schematic view (cross section along the line IV—IV) illustrating a magnetic circuit and an orientation state.
Figure 24:
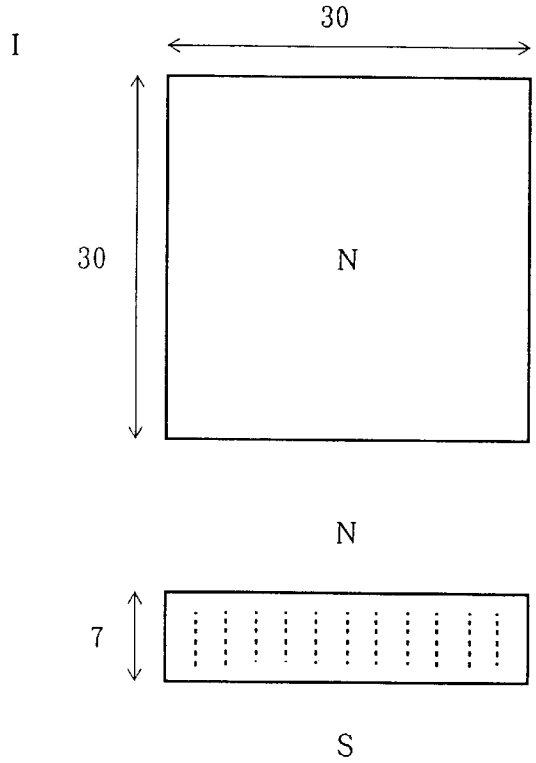
FIG. 24 is a schematic view illustrating a magnetic circuit and an orientation state.
Figure 25:
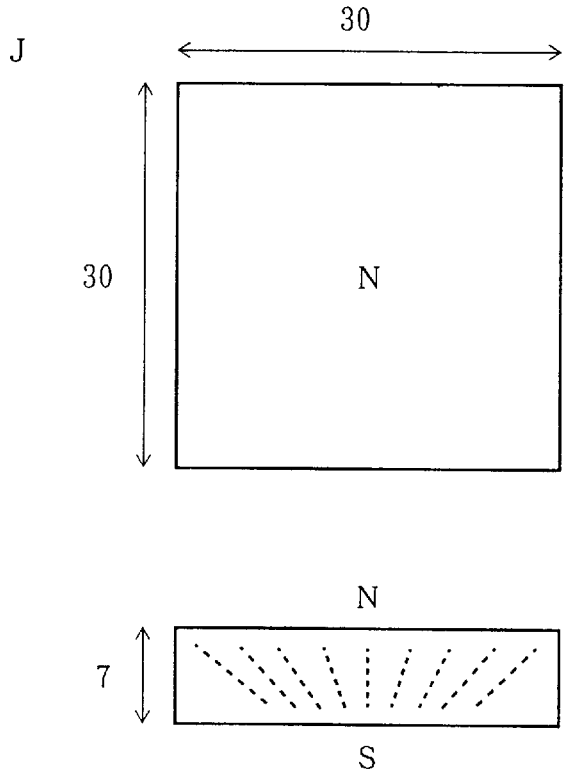
FIG. 25 is a schematic view illustrating a magnetic circuit and an orientation state.

FIG. 13 is a schematic view illustrating an example of a multiple-cavity mold for injection molding, which is approximately the same as the one shown in FIG. 3. In FIG. 13, cavities 1, a sprue 2, runners 3, permanent magnets 4, yokes (ferromagnetic substance) 5, a nonmagnetic substance 6, and ejector pins 7 are shown. FIG. 14 is a cross-sectional view along the line I—I of FIG. 13, and FIG. 15 is a cross-sectional view along the line II—II of FIG. 13.

Hereafter, the present invention will be described in further detail with reference to Examples and Comparative Examples, which are not intended to limit the present invention by any means.

EXAMPLES 1 TO 19 AND COMPARATIVE EXAMPLES 1 TO 9

Figure 7:
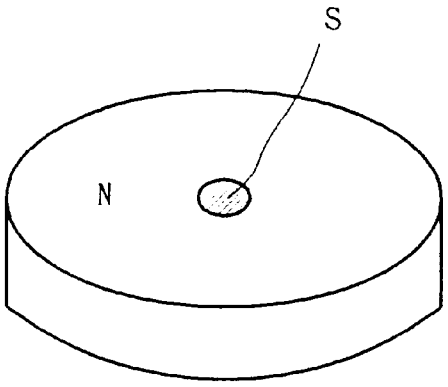
FIG. 7 is a schematic view illustrating an anisotropic permanent magnet obtained in Comparative Example 1.
Figure 8:
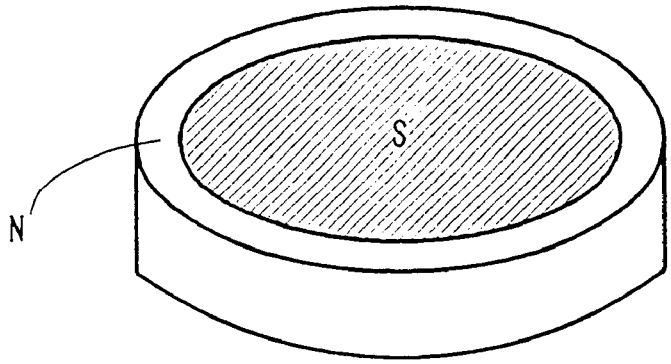
FIG. 8 is a schematic view illustrating an anisotropic permanent magnet obtained in Comparative Example 2.
Figure 9:
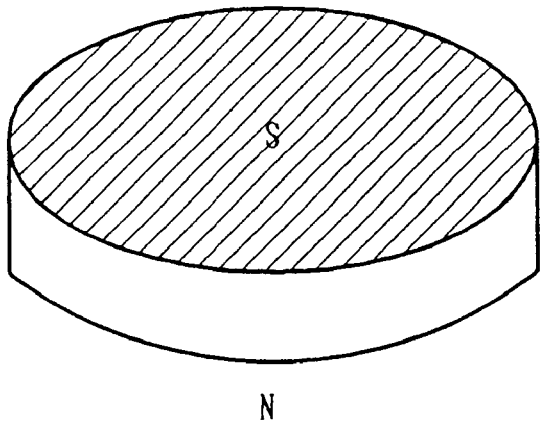
FIG. 9 is a schematic view illustrating an anisotropic permanent magnet obtained in Comparative Example 3.
Figure 10:
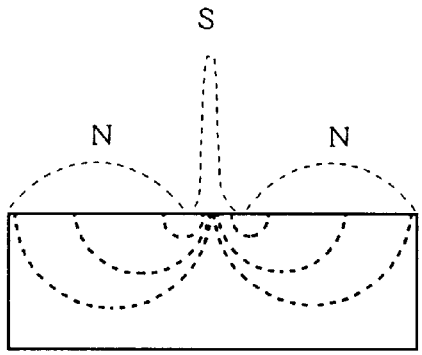
FIG. 10 is a schematic view showing an orientation state of the anisotropic permanent magnet of FIG. 7.
Figure 11:
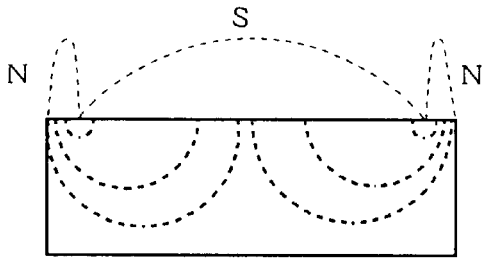
FIG. 11 is a schematic view showing an orientation state of the anisotropic permanent magnet of FIG. 8.
Figure 12:
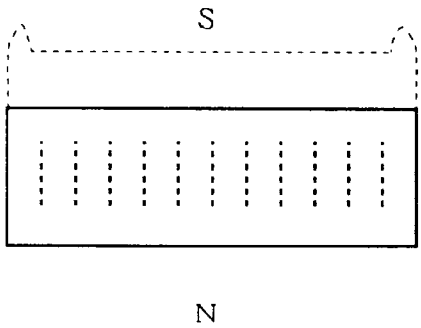
FIG. 12 is a schematic view showing an orientation state of the anisotropic permanent magnet of FIG. 9.

By means of a mold for injection molding in which a magnetic circuit shown in FIG. 3 is set, disk-shaped magnets having a diameter of 30 mm and a thickness of 7 mm were prepared by magnetic field orientation injection molding under the following blending and molding conditions, as shown in FIG. 1 (Examples) and FIGS. 7 to 9 (Comparative Examples). The preparation conditions are shown in Table 1 and Table 2. Further, the surface magnetic field of the magnets shown in FIGS. 7 to 9 is shown in FIGS. 10 to 12. In the drawings, magnetic poles shown in hatches are standard magnetic poles.

Further, by means of a compression molding apparatus (not illustrated) in which a similar magnetic circuit is set, disk-shaped magnets were likewise prepared. The preparation conditions are shown in Table 3.

With respect to the obtained disk-shaped magnets, the surface magnetic field peak value was measured by means of a gauss meter. The results are shown in Table 1 to Table 3.

As will be apparent from the results shown in Table 1 to Table 3, the anisotropic permanent magnets of the present invention in which the ratio of the standard magnetic pole area to the background opposite magnetic pole area falls within the range of 9 to 90:91 to 10 show a surface magnetic field peak value which is about two to five times larger than that of the permanent magnets that do not satisfy this range or the conventional permanent magnets that are anisotropic in the thickness direction, thereby showing a remarkable improvement.

(Materials)

Magnetic Powder Particles

Magnetic powder A: ferrite magnetic powder (magnetoplumbite type strontium ferrite having an average particle size of 1.5 $\mu$m)

Magnetic powder B: samarium-cobalt magnetic powder (samarium-cobalt magnetic powder $Sm_2Co_{17}$ having an average particle size of 10 $\mu$m)

Synthetic Resin: Polyamide 12

Plasticizer: TTS (isopropyltriisostearoyl titanate)

(Blending)

Blend A (Resin Magnet Blending)

Magnetic powder: 68 vol %

Polyamide 12:31 vol %

TTS: 1 vol %

Blend B (Sintered Magnet Blending)

Magnetic powder: 50 vol %

Water: 50 vol %

(Molding Conditions)

A: Injection molding conditions (permanent magnet incorporated magnetic field orientation injection molding apparatus)

Blending of pellets for use: blend A

Injection cylinder temperature: 280° C.

Mold temperature: 100° C.

Injection pressure: 1500 kg/cm$^2$

Excitation time: 20 seconds

Cooling time: 25 seconds

Injection cycle: 40 seconds

B: Compression Molding Conditions

Materials for use: blend B

Drainage method: chamber method

Excitation method: vertically magnetic field molding

Molding temperature: 25° C.

Sintering temperature: 1250° C.

Standard Magnetic Pole Field Magnet

A: samarium-cobalt sintered magnet

B: electromagnet

Runner Heating

A: hot runner (heated to the same temperature as the molding temperature)

B: cold runner (the same as the mold temperature)

Standard Magnet Pole Center Position

A: center

B: position away from the center by 15 mm

TABLE 1

| | Examples | | | | | | | Comparative Examples | | |
|---|---|---|---|---|---|---|---|---|---|---|
| | 1 | 2 | 3 | 4 | 5 | 6 | 7 | 1 | 2 | 3 |
| Magnetic powder | A | A | A | A | A | A | A | A | A | A |
| Blending | A | A | A | A | A | A | A | A | A | A |
| Molding conditions | A | A | A | A | A | A | A | A | A | A |
| Std. pole/Opt. pole * | 35/65 | 25/75 | 50/50 | 65/35 | 35/65 | 35/65 | 35/65 | 1/99 | 95/5 | axial |
| Standard magnetic pole field magnet | A | A | A | A | A | A | A | A | A | — |
| Runner heating | A | A | A | A | B | A | B | A | A | A |
| Standard magnet center position | A | A | A | A | A | B | B | A | A | — |
| Surface magnetic field peak value (Unit: gauss) | 2100 | 1950 | 1900 | 1700 | 2000 | 2000 | 1900 | 600 | 800 | 450 |

* Ratio of the standard magnetic pole area to the background opposite magnetic pole area

TABLE 2

| | Examples | | | | | | | Comparative Examples | | |
|---|---|---|---|---|---|---|---|---|---|---|
| | 8 | 9 | 10 | 11 | 12 | 13 | 14 | 4 | 5 | 6 |
| Magnetic powder | B | B | B | B | B | B | B | B | B | B |
| Blending | A | A | A | A | A | A | A | A | A | A |
| Molding conditions | A | A | A | A | A | A | A | A | A | A |
| Std. pole/Opt. pole * | 35/65 | 25/75 | 50/50 | 65/35 | 35/65 | 35/65 | 35/65 | 1/99 | 95/5 | axial |
| Standard magnetic pole field magnet | B | B | B | B | B | B | B | B | B | — |
| Runner heating | A | A | A | A | B | A | B | A | A | A |
| Standard magnet center position | A | A | A | A | A | B | B | A | A | — |
| Surface magnetic field peak value (Unit: gauss) | 3900 | 3650 | 3500 | 3200 | 3500 | 3600 | 3350 | 850 | 1250 | 800 |

* Ratio of the standard magnetic pole area to the background opposite magnetic pole area

TABLE 3

| | Examples | | | | | Comparative Examples | | |
|---|---|---|---|---|---|---|---|---|
| | 15 | 16 | 17 | 18 | 19 | 7 | 8 | 9 |
| Magnetic powder | A | A | A | A | A | A | A | A |
| Blending | B | B | B | B | B | A | A | A |
| Molding conditions | B | B | B | B | B | B | B | B |
| Std. pole/Opt. pole * | 35/65 | 25/75 | 50/50 | 65/35 | 35/65 | 1/99 | 95/5 | axial |
| Standard magnet pole field magnet | B | B | B | B | B | B | B | — |
| Runner heating | — | — | — | — | — | — | — | — |
| Standard magnet center position | A | A | A | A | B | A | A | — |
| Surface magnetic field peak value (Unit: gauss) | 2600 | 2450 | 2400 | 2200 | 2300 | 750 | 1050 | 560 |

* Ratio of the standard magnetic pole area to the background opposite magnetic pole area As will be apparent from Table 1 to Table 3, the anisotropic permanent magnet of the present invention shows a great improvement in the surface magnetic field peak value, and is useful as a magnet for a signal, a magnet for a health appliance, and others.

EXAMPLES 20 TO 27 AND COMPARATIVE EXAMPLES 10 TO 17

By means of a mold for injection molding in which a magnetic circuit shown in FIG. 13 is set, square-shaped magnets each having a side of 30 mm (Examples 20 to 25 and Comparative Examples 10 to 13) and disk-shaped magnets having a diameter of 30 mm (Examples 26 to 27 and Comparative Examples 14 to 17) were prepared by magnetic field orientation injection molding under the following blending and molding conditions, as shown in FIGS. 16 to 31. In the drawings, the unit for dimension is millimeter.

Figure 26:
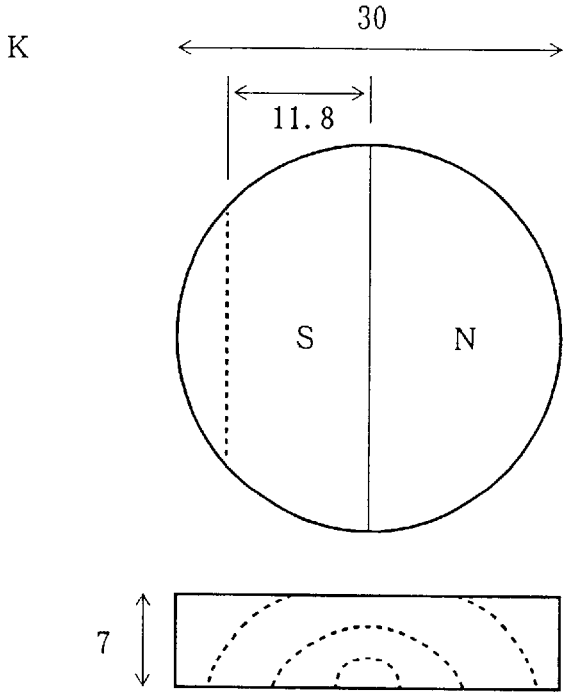
FIG. 26 is a schematic view illustrating a magnetic circuit and an orientation state.
Figure 27:
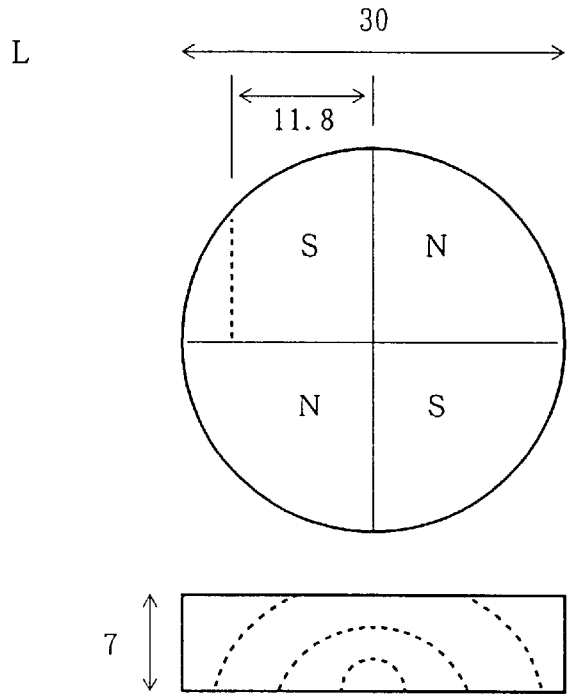
FIG. 27 is a schematic view illustrating a magnetic circuit and an orientation state.
Figure 28:
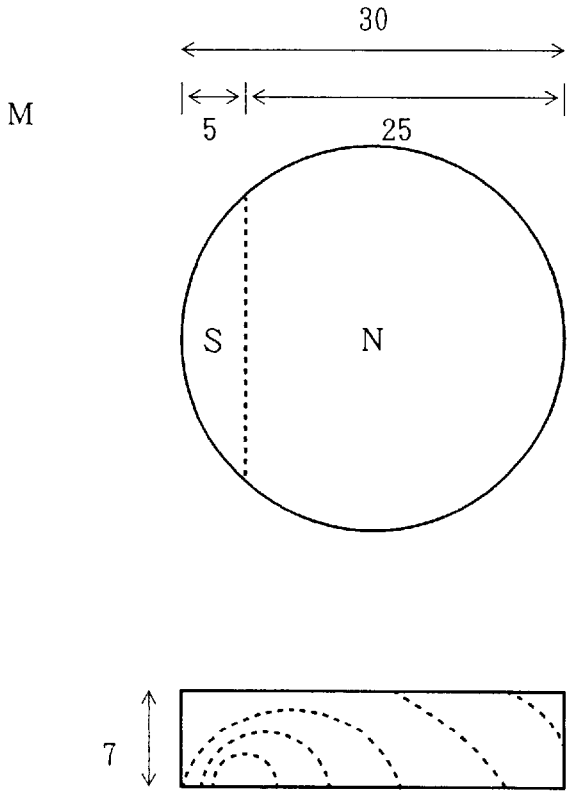
FIG. 28 is a schematic view illustrating a magnetic circuit and an orientation state.
Figure 29:
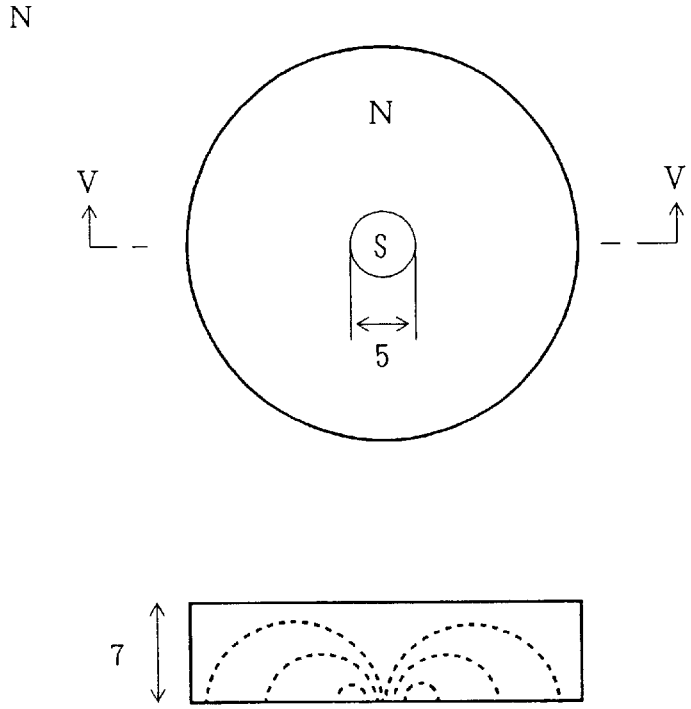
FIG. 29 is a schematic view (cross section along the line V—V) illustrating a magnetic circuit and an orientation state.
Figure 30:
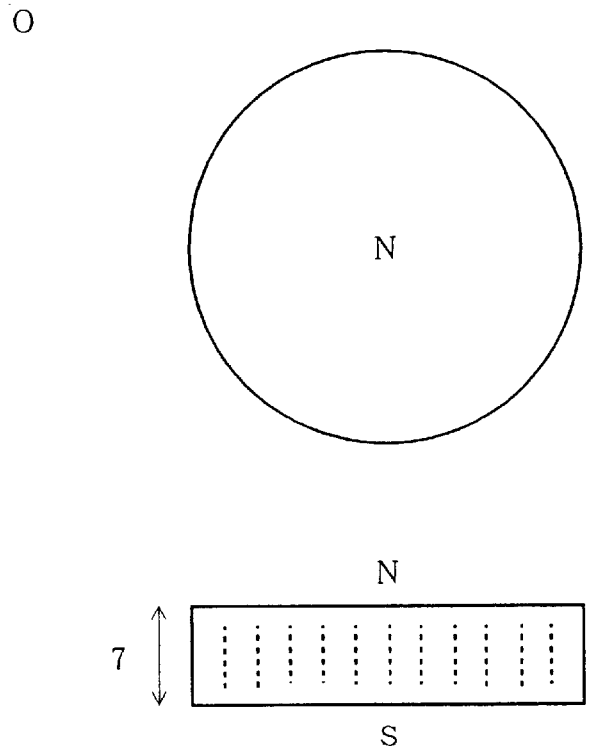
FIG. 30 is a schematic view illustrating a magnetic circuit and an orientation state.
Figure 31:
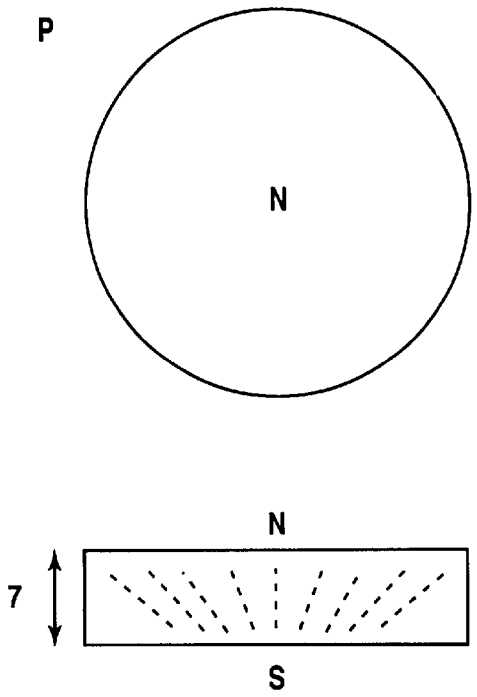
FIG. 31 is a schematic view illustrating a magnetic circuit and an orientation state.
Figure 32:
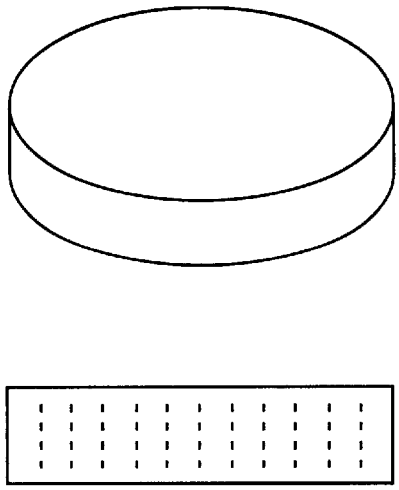
FIG.32 PRIOR ART
FIG. 32 is a schematic view illustrating a conventional permanent magnet which is anisotropic in an axial direction.
Figure 33:
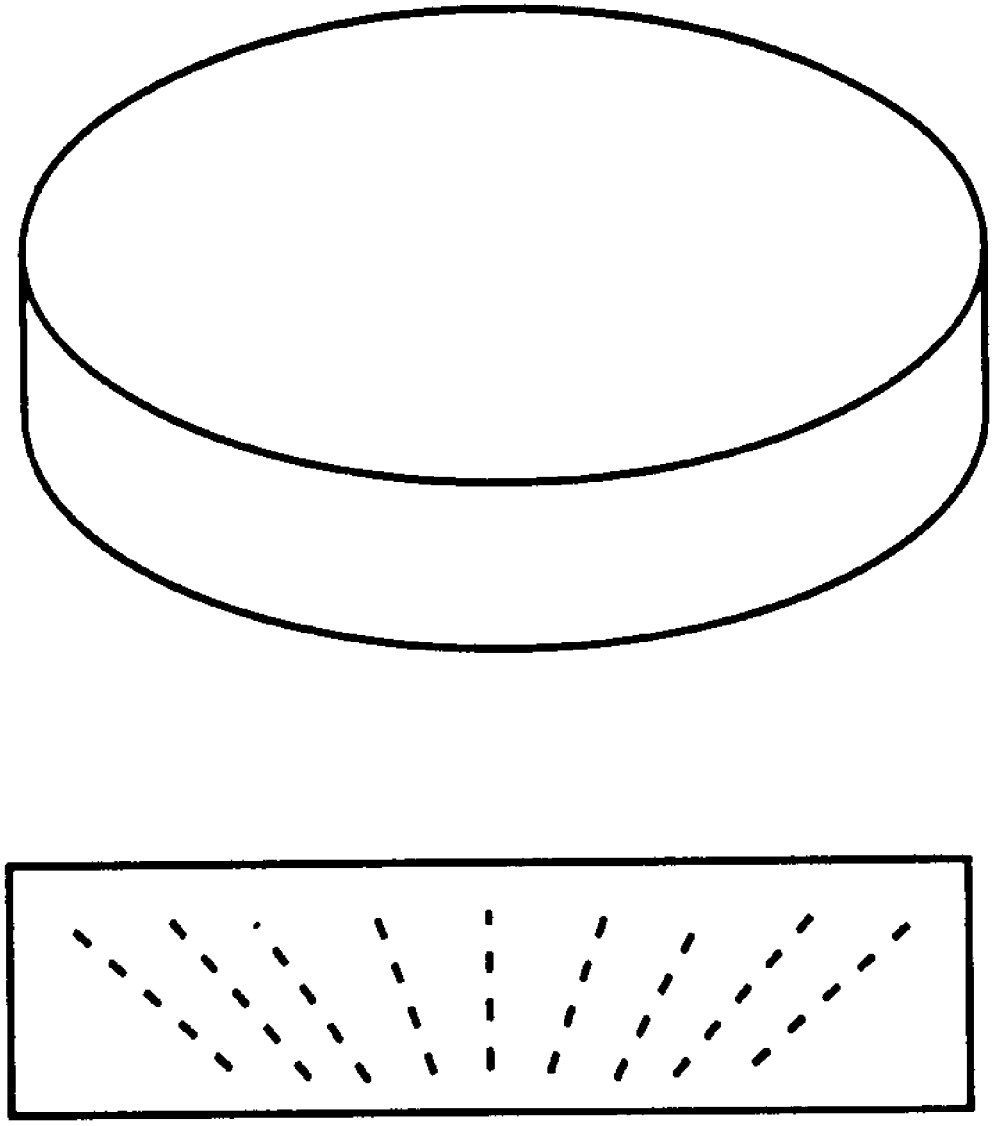
FIG.33 PRIOR ART
FIG. 33 is a schematic view illustrating a conventional permanent magnet having a converging orientation.

Here, in FIGS. 26 and 27, the pitch was defined by dividing the area of individual magnets by the diameter.

(Blending)

Magnetic powder (ferrite magnetic powder: magnetoplumbite strontium ferrite having an average particle size of 1.5 $\mu$m) 68 vol %

Synthetic resin (polyamide 12) 31 vol %

Plasticizer (TTS: isopropyltriisostearoyl titanate) 1 vol %

(Molding Conditions)

Injection cylinder temperature: 280° C.

Mold temperature: 100° C.

Injection pressure: 1500 kg/cm$^2$

Excitation time: 20 seconds

Cooling time: 25 seconds

Injection cycle: 40 seconds

The attraction force (object of attraction: iron plate having a thickness of 2 mm) after the simultaneous orientation and magnegtized of the obtained square-shaped magnets and disk-shaped magnets was measured. The results are shown in Table 4.

Here, the attraction force was measured by utilizing an autograph, and measured in the direction of pulling the magnet away perpendicularly to the direction in which the magnet was allowed to be attracted.

TABLE 4

| | Examples | | | | | | | |
|---|---|---|---|---|---|---|---|---|
| | 20 | 21 | 22 | 23 | 24 | 25 | 26 | 27 |
| | Square-shaped | | | | | | Disk-shaped | |
| Shape of magnet | A | B | C | D | E | F | K | L |
| ΣS | ΣN | 0.88 ΣN | ΣN | ΣN | ΣN | ΣN | ΣN | ΣN |
| Pmax | 1.43 T | — | 2.14 T | 1.7 T | 0.5 T | 2.14 T | 1.68 T | 1.68 T |
| Pmax/Pmin | 1.0 | — | 1.0 | 3.0 | 1.0 | 1.0 | 1.0 | 1.0 |
| Attraction force (g) | 1900 | 1800 | 1700 | 1500 | 1950 | 1750 | 1500 | 1500 |

| | Comparative Examples | | | | | | | |
|---|---|---|---|---|---|---|---|---|
| | 10 | 11 | 12 | 13 | 14 | 15 | 16 | 17 |
| | Square-shaped | | | | Disk-shaped | | | |
| Shape of magnet | G | H | I | J | M | N | O | P |
| ΣS | 0.2 ΣN | 0.03 ΣN | 0 ΣN | 0 ΣN | 0.1 ΣN | 0.03 ΣN | 0 ΣN | 0 ΣN |
| Pmax | — | — | — | — | — | — | — | — |
| Pmax/Pmin | — | — | — | — | — | — | — | — |
| Attraction force (g) | 500 | 400 | 610 | 900 | 300 | 200 | 500 | 750 |

EXAMPLES 28 to 32 AND COMPARATIVE EXAMPLES 18 TO 21

Square-shaped magnets and disk-shaped magnets were prepared in the same manner as in Examples 20 to 27 and Comparative Examples 10 to 17 except that the blending was changed to the following blending. The result of measurement of the attraction force are shown in Table 5.

(Blending)

Magnetic powder (samarium-cobalt magnetic powder: $Sm_2Co_{17}$ having an average particle size of 10$\mu$m) 68 vol %

Synthetic resin (polyamide 12) 31 vol %

Plasticizers (TTS: isopropyltriisostearoyl titanate) 1 vol %

TABLE 5

| | Examples | | | | | Comparative Examples | | | |
|---|---|---|---|---|---|---|---|---|---|
| | 28 | 29 | 30 | 31 | 32 | 18 | 19 | 20 | 21 |
| | Square-shaped | | | Disk-shaped | | Square-shaped | | Disk-shaped | |
| Shape of magnet | A | C | D | K | L | I | J | O | P |
| ΣS | ΣN | ΣN | ΣN | ΣN | ΣN | 0 ΣN | 0 ΣN | 0 ΣN | 0 ΣN |
| Pmax | 1.43 T | 2.14 T | 1.7 T | 1.68 T | 1.68 T | — | — | — | — |
| Pmax/Pmin | 1.0 | 1.0 | 1.0 | 1.0 | 1.0 | — | — | — | — |
| Attraction force (g) | 2700 | 2400 | 3100 | 2950 | 3000 | 1300 | 1900 | 1100 | 1500 |

EXAMPLES 33 TO 35 AND COMPARATIVE EXAMPLES 22 TO 25

By means of a compression molding apparatus, square-shaped magnets having a side of 30 mm and disk-shaped magnets having a diameter of 30 mm were prepared under the following blending and molding conditions. The results of measurement of the attraction force are shown in Table 6.

(Blending)

Magnetic powder (ferrite magnetic powder: magnetoplumbite strontium ferrite having an average particle size of 1.5 $\mu$m) 50 vol %

Water 50 vol %

(Molding Conditions)

Drainage method: chamber method

Excitation method: vertically magnetic field molding

Molding temperature: 25° C.

Sintering temperature: 1250° C.

TABLE 6

| | Examples | | | Comparative Examples | | | |
|---|---|---|---|---|---|---|---|
| | 33 | 34 | 35 | 22 | 23 | 24 | 25 |
| | Square-shaped | | Disk-shaped | Square-shaped | | Disk-shaped | |
| Shape of magnet | A | C | L | I | J | O | P |
| ΣS | ΣN | ΣN | ΣN | 0 ΣN | 0 ΣN | 0 ΣN | 0 ΣN |
| Pmax | 1.43 T | 2.14 T | 1.68 T | — | — | — | — |
| Pmax/Pmin | 1.0 | 1.0 | 1.0 | — | — | — | — |
| Attraction force (g) | 2600 | 2400 | 2100 | 850 | 1300 | 700 | 1000 |

As is apparent from the results shown in Table 4 to Table 6, it will be understood that the permanent magnets for attraction of the present invention in which ΣS and ΣN fall within a specific range show an attraction force which is about three times larger at the maximum than that of the permanent magnets that do not satisfy this range or the conventional permanent magnets that are anisotropic in the thickness direction or the converging orientation permanent magnets, thereby showing a remarkable improvement.

Here, Examples 22, 29, and 34 show a little decreased attraction force because they do not satisfy the requirements of claim 9, although they satisfy the requirements of claim 8. And Example 23 also shows a little decreased attraction force because it does not satisfy the requirements of claim 10, although it satisfies the requirements of claim 8. However, the magnets of these Examples all have a practically sufficient attraction force.

Further, since Example 24 shows a Pmax value approximately equal to the lower limit of 0.5×T, the magnet composition on the nonactive surface side goes out of the magnetic circuit that contributes to the attraction, so that it is uneconomical in terms of costs.

As the present invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An anisotropic permanent magnet containing a magnetic powder and having at least one substantially planar surface, in which magnetic flux lines pass from said surface through an interior of the magnet to return to said surface, wherein a standard magnetic pole and an opposite magnetic pole are present on said surface, and a ratio of an area of the standard magnetic pole to an area of the opposite magnetic pole is 9 to 90:91 to 10.

2. An anisotropic permanent magnet according to claim 1, wherein the permanent magnet contains a magnetic powder and a synthetic resin as major components.

3. An anisotropic permanent magnet for providing a magnetic signal, which comprises an anisotropic permanent magnet according to any one of claims 1 to 2.

4. An anisotropic permanent magnet according to claim 3, comprising a fundamental signal unit which includes the standard magnetic pole surrounded by the opposite magnetic pole.

5. An anisotropic permanent magnet for a signal according to claim 3, which is constructed by repetition of fundamental signal units.

6. A permanent magnet for attraction containing a magnetic powder and having a substantially planar surface, in which magnetic flux lines pass from said surface through an interior of the magnet to return to said surface, wherein a total area $\Sigma S$ of an S pole surface and a total area $\Sigma N$ of an N pole surface satisfy a relationship: $0.5\times\Sigma S \leqq \Sigma N \leqq 2.0\times\Sigma S$ or $0.5\times\Sigma N \leqq \Sigma S \leqq 2.0\times\Sigma N$.

7. A permanent magnet for attraction according to claim 6, wherein a maximum width Pmax of a magnetization pattern of said surface and a thickness T of the permanent magnet satisfy a relationship: $0.5\times T \leqq Pmax \leqq 2.0\times T$.

8. A permanent magnet for attraction according to claim 6 or 7, wherein a ratio (Pmax/Pmin) of a maximum value Pmax to a minimum value Pmin of a width P of a magnetization pattern of said surface of the anisotropic magnet is not more than 2.

9. An anisotropic permanent magnet according to claim 1, wherein the standard magnetic pole is surrounded by the opposite magnetic pole.

10. An anisotropic permanent magnet according to claim 2, wherein the standard magnetic pole is surrounded by the opposite magnetic pole.

* * * * *